US008516849B2

(12) United States Patent
Mooijer et al.

(10) Patent No.: US 8,516,849 B2
(45) Date of Patent: Aug. 27, 2013

(54) COOLER AND METHOD FOR COOLING BEVERAGE CONTAINERS SUCH AS BOTTLES AND CANS

(75) Inventors: Ronald Johannes Mooijer, Edam (NL); Hans-Peter Voss, Almere (NL); Patrick Johannes Blom, Leiden (NL)

(73) Assignee: Heineken Supply Chain B.V., Amsterdam (NL)

( * ) Notice: Subject to any disclaimer, the term of this patent is extended or adjusted under 35 U.S.C. 154(b) by 403 days.

(21) Appl. No.: 12/745,837

(22) PCT Filed: Dec. 3, 2008

(86) PCT No.: PCT/NL2008/050765

§ 371 (c)(1),
(2), (4) Date: Aug. 10, 2010

(87) PCT Pub. No.: WO2009/072876

PCT Pub. Date: Jun. 11, 2009

(65) Prior Publication Data

US 2010/0293970 A1 Nov. 25, 2010

(30) Foreign Application Priority Data

Dec. 4, 2007 (NL) ..... 2001054

(51) Int. Cl.
*F25D 3/08* (2006.01)

(52) U.S. Cl.
USPC ..... 62/457.5; 62/457.9

(58) Field of Classification Search
USPC ..... 62/62, 465, 452, 498, 457.5, 457.4, 62/457.9; 220/495.03, 592.16
See application file for complete search history.

(56) References Cited

U.S. PATENT DOCUMENTS

| | | | | |
|---|---|---|---|---|
| 1,937,797 | A | 12/1933 | Stafney | |
| 2,072,347 | A | 3/1937 | Strebler | |
| 2,418,300 | A | 4/1947 | Hagstrom | |
| 2,572,508 | A | 10/1951 | Muffly | |
| 3,049,890 | A | 8/1962 | Ruppel | |
| 5,191,773 | A | 3/1993 | Cassell | |
| 5,557,943 | A * | 9/1996 | Coelho et al. | 62/376 |
| 6,109,056 | A * | 8/2000 | Feldpausch | 62/356 |
| 6,474,093 | B1 * | 11/2002 | Fink et al. | 62/434 |
| 6,564,992 | B1 * | 5/2003 | Wegner | 229/117.35 |
| 6,763,959 | B2 * | 7/2004 | Tedder | 211/188 |
| 6,895,778 | B1 * | 5/2005 | Ackerman | 62/457.7 |
| 6,945,450 | B2 * | 9/2005 | Rusnock | 229/243 |
| 6,990,831 | B2 * | 1/2006 | Fiene | 62/457.5 |
| 7,024,882 | B2 * | 4/2006 | Carmichael et al. | 62/457.5 |
| 7,097,034 | B2 * | 8/2006 | Woog | 206/427 |
| 2003/0200757 | A1 | 10/2003 | Hawkins, Jr. et al. | |
| 2004/0003600 | A1 | 1/2004 | Hawkins, Jr. et al. | |
| 2005/0086947 | A1 | 4/2005 | Minoura | |

* cited by examiner

FOREIGN PATENT DOCUMENTS

| | | | |
|---|---|---|---|
| EP | 0 491 671 | A1 | 6/1992 |
| JP | 2005 127608 | A | 5/2005 |

*Primary Examiner* — Mohammad M Ali
(74) *Attorney, Agent, or Firm* — Pearne & Gordon LLP

(57) ABSTRACT

A cooler for beverage containers, comprising an outer holder (5) and at least one inner holder (17), received in the outer holder (5), provided with: at least a series of receiving positions (28) within the inner holder, for beverage containers (30); a cooling device (13) for forming an ice layer between the at least one inner holder and the outer holder; pumping means (22) for drawing coolant from the at least one inner holder (17) and lifting coolant between the inner holder (17) and the outer holder (5); at least one overflow (32) for reintroducing lifted coolant into the inner holder (17).

40 Claims, 5 Drawing Sheets

COOLER AND METHOD FOR COOLING BEVERAGE CONTAINERS SUCH AS BOTTLES AND CANS

The invention relates to a cooler for beverage containers such as bottles and cans.

Beverage, such as beer and soft drinks, are usually drunk refrigerated. In some cases it is even preferred to cool the beverage to approximately 0° C., or below 0° C. For cooling, the beverage, in beverage containers such as bottles or cans, can be put in a refrigerator, in order to cool down from room temperature to the desired temperature. A drawback thereof is that it takes relatively long for the beverage to reach the desired temperature. Furthermore, such cooling can be energetically disadvantageous, in particular when the refrigerator is only partly filled.

The object of the invention is to provide a cooler with which beverage containers can be cooled. In a first aspect, a cooler is characterized in that an outer holder and at least one inner holder are provided, with the inner holder received in the outer holder. In the inner holder, at least a series of receiving positions for beverage containers are provided, while a cooling device is provided for forming an ice layer between the at least one inner holder and the outer holder. Furthermore, pumping means are provided for drawing coolant from the inner holder and lifting coolant between the inner-holder and the outer holder. At least one overflow is provided for reintroducing lifted coolant into the inner holder.

In a second aspect, a cooler can be characterized in that it is at least partly filled with beverage containers, while a receiving position encloses a beverage container relatively closely over at least a part of the height of the beverage container.

In a further aspect, the invention can be characterized by a method for cooling beverage containers, wherein beverage containers are arranged in an inner holder and a coolant is guided over and/or along the beverage containers, in liquid contact with the beverage containers. The coolant is drawn from the inner holder and guided along a cooling device, at least partly disposed between the inner holder and an outer holder, and is thus cooled. The cooled coolant is lifted to beyond an overflow of the inner holder and guided back via the overflow and/or along the beverage containers. Here, by the cooling device, an ice layer is built up and/or maintained between the inner holder and the outer holder.

In clarification of the invention, embodiments of a cooler and method will be explained in further detail on the basis of the drawing. In the drawing:

FIG. 1 shows, in perspective view, a cooler with partly broken away wall;

FIG. 2 schematically shows two inner holders in top plan view;

FIG. 3 schematically shows a cooler in cross sectional side view;

FIG. 3A schematically shows, in side view, a part of an alternative embodiment of a cooler;

FIGS. 4A-C show, in perspective views, a cooler in filled, partly closed condition, in empty, opened condition and in a condition with taken away inner holders, respectively;

In this description, identical or corresponding parts have identical or corresponding reference numerals. The embodiments shown are merely shown by way of illustration and should not be taken as being limitative in any manner.

Figure 1:
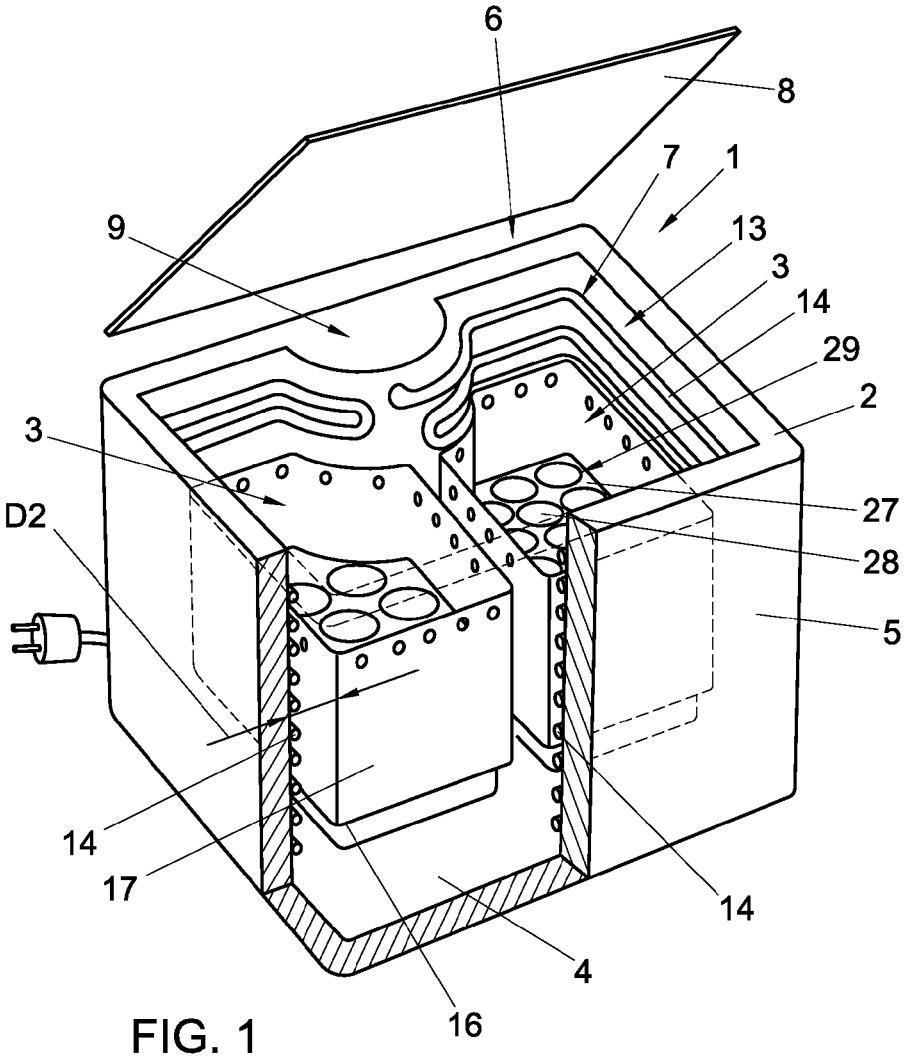
Figure 3:
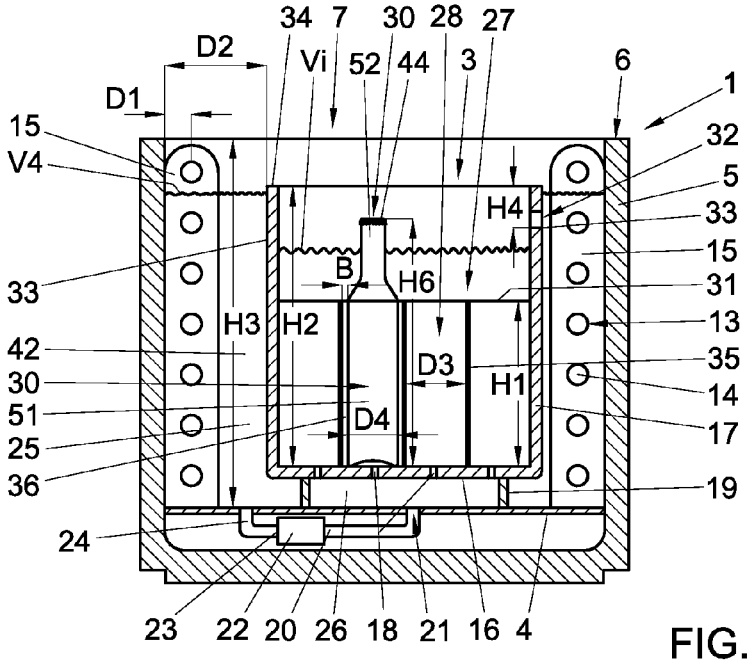
Figure 7:
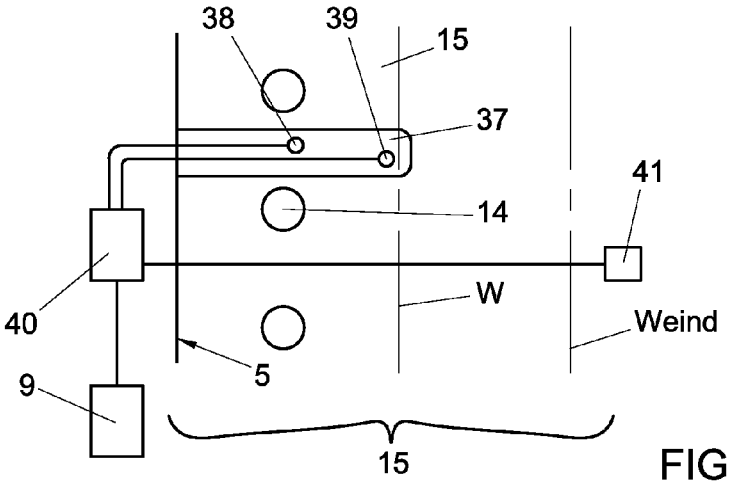
FIG. 7 schematically shows a part of a cooler with an ice sensor and an ice layer.

In FIG. 1, in perspective view, a cooler 1 is shown, provided with one outer holder 2 and two inner holders 3 received therein. In this case, the outer holder 2 is substantially tray-shaped and has a bottom 4 and a wall 5. The bottom 4 and the wall 5 are thermally insulated. The outer holder 2 is liquid tight, and provided at the top 6 with an opening 7. A lid 8 such as one or more sliding lid parts, a folding lid or a removable lid or combinations thereof may be provided for covering the outer holder 2. Preferably, such a lid is thermally insulating. The outer holder 2 is provided with a chamber 9 in which a compressor 10 and a condenser 11 are received. These form part of a cooling device 12, which further comprises a pipe system 13 connected to the compressor 10 and the condenser 11. The pipe system 13 comprises one or more pipes 14 extending at the inside of the outer holder 2 along the wall 5, in a spiral or zigzag configuration, such that over substantially the entire inside of the wall 5 a pattern of pipes 14 is obtained. The pipes 14 are preferably at some distance from the wall 5, for instance a distance D1 of a few millimeters or more. The pipe system 13 is filled with a coolant known from cooling technology. This can be circulated by the compressor 10 through the pipe system, and along or through the condenser 11. The pipe system 13 forms an evaporator V of the cooling device 12, in the cooler 1. With it, during use, an ice layer 15 as shown in FIGS. 3, 4 and 7 can be formed on the pipe system 13 and against the wall 5. This will be described in further detail.

Inside the outer holder 2, the inner holders 3 are arranged, side by side. In the example shown, the inner holders 3 are mirror symmetrical. Mostly, only one such inner holder 3 will be described. The inner holders 3 each have substantially a tray-shape with a bottom 16 and a wall 17. Between the wall 17 of each inner holder 3 and the pipes 13 on the wall 5 of the outer holder 2, there is always some distance, for instance a distance D2 of a few millimeters to a few centimeters. The bottom 16 of each inner holder 3 is placed on the bottom 4 of the outer holder 2. The bottom 16 of each inner holder is provided with a pattern of openings 18.

Figure 3A:
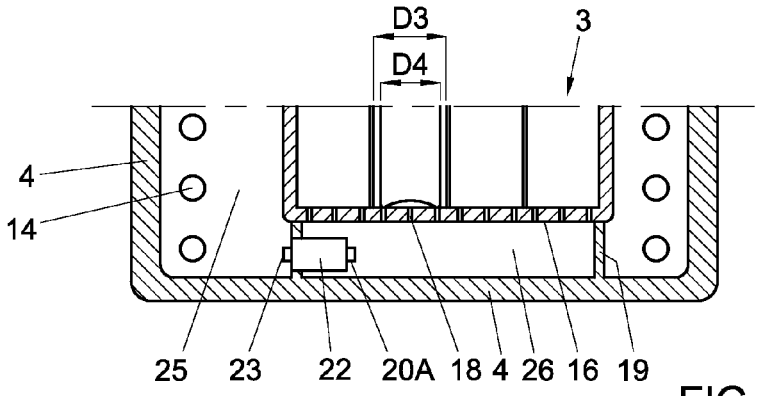

Between the bottom 16 of the inner holder 3 and the bottom 4 of the outer holder 2, a hollow socket 19 is provided, for instance as part of the outer holder 2, the inner holder 3, both, or as separate part. This is schematically shown in FIG. 3 in cross sectional side view. The or each opening 18 in the bottom 16 of the inner holder 3 is in liquid communication with the space 26 defined by the socket 19, the bottom 4 and the bottom 16. In or on the bottom 4, under the bottom 16, on the space 26 inside the socket 19, a suction pipe 20 is connected, having a suction opening 21 inside the socket 19. The suction pipe 20 is connected to a pump 22. The pump 22 is provided with a discharge stub 23 which opens, optionally via a discharge pipe 24, into the space 25 between the inner holders 3 and the outer holder 5. In one embodiment, both suction pipes 20 can be connected to the same pump 22. In another embodiment, for each inner holder 3 a pump 22 can be provided. In a further alternative embodiment, a pump 22 can be directly connected to the discharge openings 18. In FIG. 3A, an alternative embodiment is shown, wherein the pump 22 has a suction stub or suction opening 20A which opens into the space 26 inside the socket 19, and a discharge stub 23 which reaches through the wall of the socket 19. With it, liquid can be drawn from the inner holder 3 directly via the openings 18 into the space 26 in the socket and from thence to the space 25 between the inner holder 3 and the outer holder 2. Tubes and the like can thus be omitted, while relatively few seals need to be provided, which is technically advantageous both in structure and operation.

Figure 2:
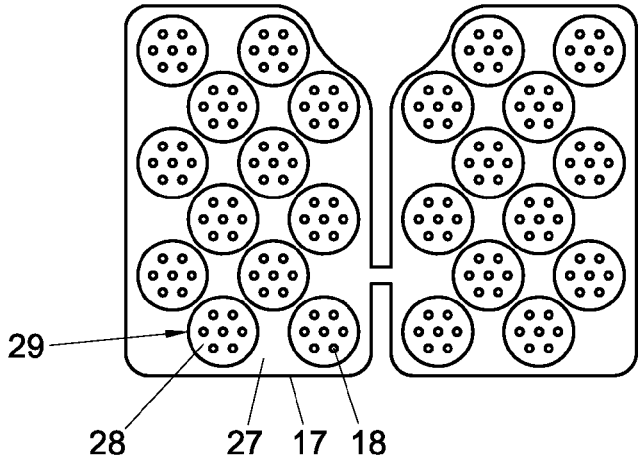
Figure 6:
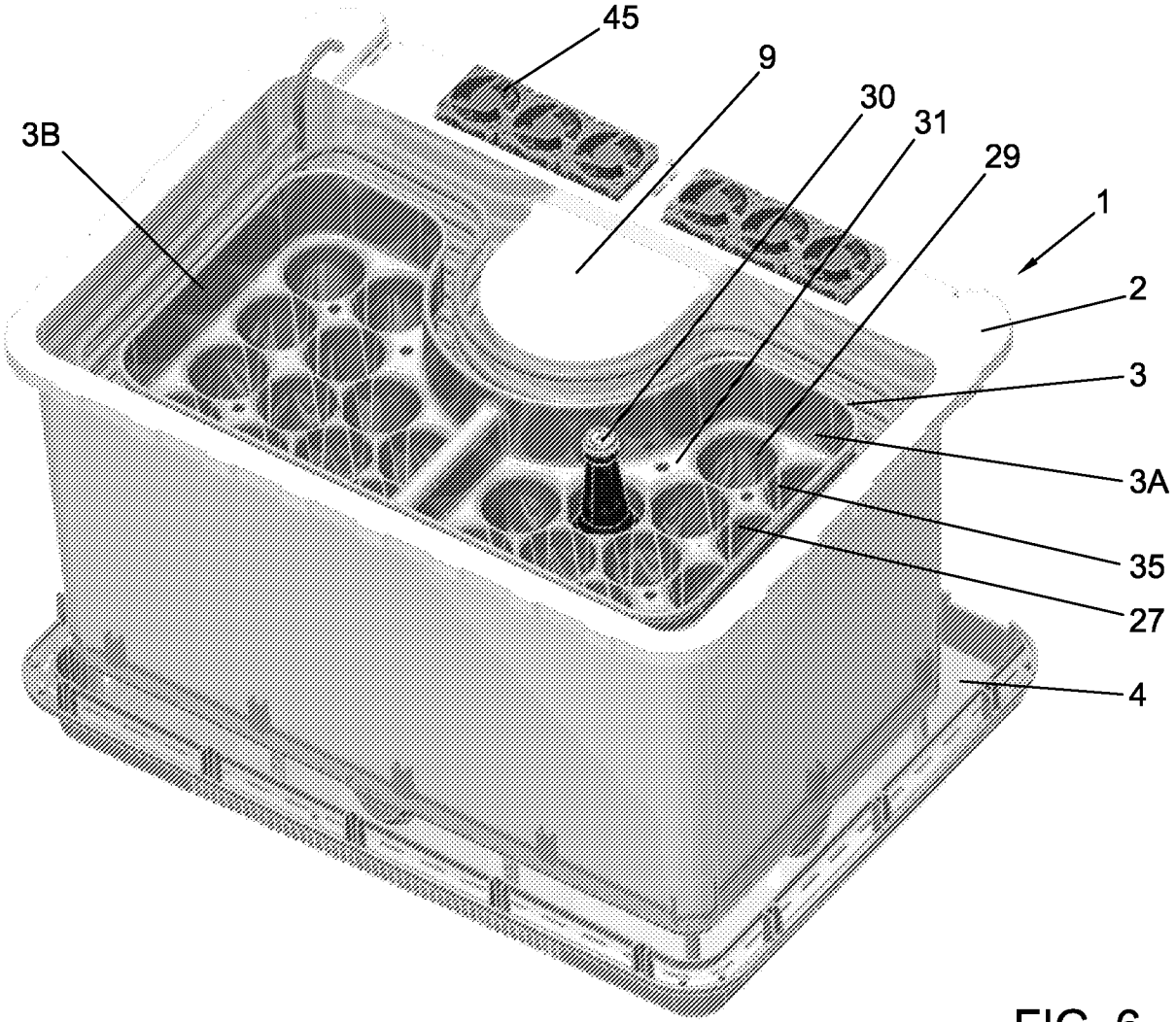
FIG. 6 shows in perspective top plan view a cooler with outer holder partly taken away.

The inner holder 3 can be provided with a compartmentation 27. Thus defined compartments 28 form receiving positions 29 for beverage containers 30. In FIG. 2, an example of a possible pattern of receiving positions 29 is represented. In this embodiment, each inner holder 3 has twelve receiving positions, so that in total twenty four beverage containers 30 can be simultaneously received in the inner holders 3. In FIG. 4, an embodiment is shown wherein the compartments have non-closed walls formed by, for instance, pillars. In FIG. 6, a further embodiment is shown wherein one inner holder is included, divided into two compartments 3A, 3B each comprising twelve receiving positions 29, defined by closed walls. Naturally, other numbers of receiving positions and/or other configurations of the compartmentations 27 are possible. Under each compartment 28 there is at least one opening 18 and preferably a pattern of openings 18. Preferably, for all compartments 27, openings 18 are provided such that therefrom, during use, per unit of time, approximately the same amount of liquid can flow. The compartmentation 27 is built up from walls 35 which are mutually connected in a manner such that substantially each compartment 28 is separated from neighbouring compartments 28. The walls 29 can be provided as separate parts and be assembled to form a compartmentation 27. However, it is preferred that the compartmentation 27 is of one-part design, for instance forming one part with the bottom 16 and the wall 17. The inner holder 3 can for instance be injection molded in one piece.

As can be seen in particular in FIGS. 1, 3, 4 and 7, the compartmentation 27 has an upper longitudinal edge 31, or at least a top face. The compartments 28 each have a substantially similar form and similar sizes. The height H1 of the compartmentation, measured at the inside, is smaller than the height H2 of the wall 16 of the inner holder 3, measured at the inside. The height H3 of the outer holder 2, measured at the inside, is greater than the height H2. In the exemplary embodiment shown, the compartments 28 are substantially cylindrical, with a diameter D3. The wall 5 of the inner holder 3 is provided with at least one overflow 32. In the exemplary embodiment shown, the overflow 32 is substantially defined by a series of openings 33 provided in the wall 16, at a distance H4 below the longitudinal edge 34 of the wall 16. The distance H4 is smaller than the difference between the heights H1 and H2. The distance H4 is for instance a third or less of this difference, more particularly a quarter or less.

In the exemplary embodiment shown in FIG. 3, each compartment 28 is designed to receive a bottle as beverage container 30. The bottle 30 has a body 51 and a neck 52. The body 51 has a height H5 which is approximately equal to the height H1 of the compartmentation 27. Furthermore, the body 51 has a substantially cylindrical form with a cross section D4 which is somewhat smaller than the diameter D3 of the compartments 28. The difference in diameter is preferably relatively small, for instance some millimeters. In one embodiment, the difference in diameter can be such that between the wall 35 of the compartment 28 and the body 51 of the bottle 30 a gap 36 is formed having an average width B, measured as shortest distance between wall 35 and body 51, of between approximately zero and five millimeters, more particularly between approximately zero and three millimeters. In one embodiment, the width B can be between approximately half a millimeter and three millimeters. An advantageous width B can for instance be two millimeters. The height H6 of the bottle 30 can be greater than the difference between the height H3 of the wall 5 and the distance H4 between the edge 34 and the openings 33, so that a top end 44 of the bottle 30, for instance open, or closed by a cap, is above the level of the overflow 32. The bottle 30, for that matter, can also have a different height, for instance such that it remains below the level of the overflow 32.

In FIG. 3 it is schematically shown that in the inner holder 3, there can be a liquid level Vi which is lower than the openings 33 and furthermore lower than a liquid level Vu in the space 25 between the inner holder 3 and the outer holder 2 yet preferably above the edge 31 of the walls 30. Advantageously, the liquid level Vu can be above the openings 33 but below the longitudinal edge 34, while the liquid level Vi can advantageously be between the longitudinal edge 3 of the compartmentation 27 and the openings 33. When determining the position of the openings 33, always, the location of a center thereof will be the starting point, unless expressly indicated otherwise. The pump is selected or adjusted such that its lifting level provides the desired liquid levels Vi and, in particular, Vu. During use, water will flow through the overflow 32 formed by the openings 33, whereby the liquid level Vu effects a substantially equal or at least constant liquid flow through all openings 33. The openings 33 can be placed such that for instance the liquid flows against a neck 52 of a bottle 30, or, conversely, between the bottles 30. Preferably, the level Vi is at a height between the longitudinal edges 30 and the top end 44 of the bottles 30, for instance near the middle of the neck 52. As the liquid level Vi is somewhat above the longitudinal edges 30, the liquid pressure on each of the receiving positions will always be approximately equal, so that a uniform liquid flow pattern along the bottles 30 can be maintained, also when for instance the cooler 1 is not precisely level. Along all bottles 30, always an approximately equal liquid flow will occur, so that the bottles 30 are approximately uniformly cooled. At least for comparable reasons, the location of the openings 33 below the liquid level Vu can be of advantage. This can facilitate placement of the cooler.

As schematically shown in FIG. 7, at the inside of the wall 5 of the outer holder 2, an ice sensor 37 is provided. This may be a resistance meter and can comprise, for instance, two spaced apart and mutually insulated electrodes 38, 39. As long as there is no ice between them, the electrodes will measure a particularly high resistance. If ice has formed between the electrodes 38, 39, a current with a relatively low resistance can run between the electrodes. Thus, a layer of ice can be measured having a thickness W which at least approximately corresponds with the distance between the electrodes 38, 39. This thickness W can be used as a limit value, as will be explained in further detail. A control device 40 is connected to the cooling means 9, in particular to the compressor 10, for controlling this. Furthermore, at least the sensor 37 is connected to the control device 40. Further, a temperature sensor 41 can be connected to the control device 40, with which the temperature in the cooler 1 can be measured, for instance of a coolant 42 present therein. With it, for instance an indication of a temperature of the coolers 30 can be obtained.

Figures 4A, 4B, 4C:
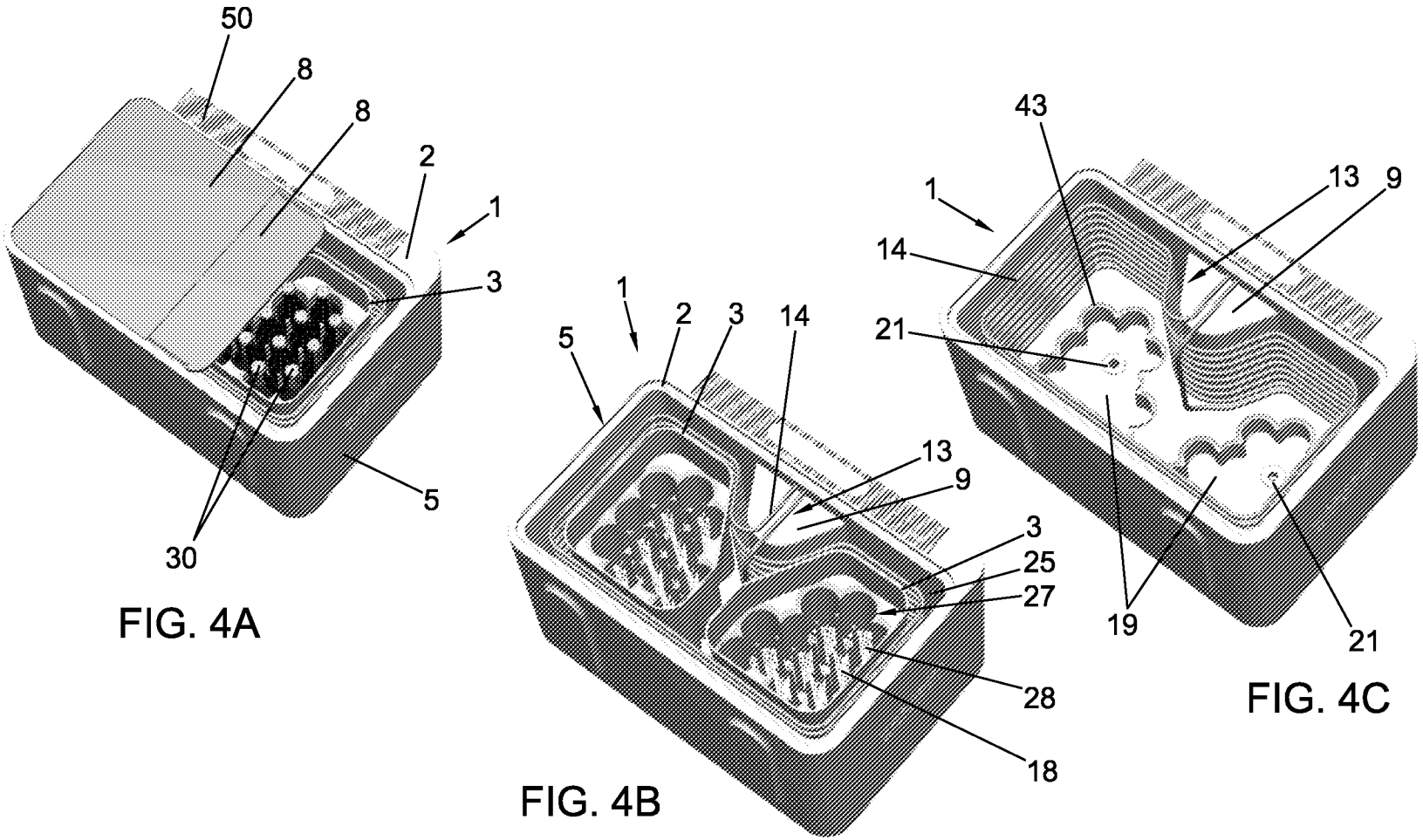

In FIG. 4A-4C, an embodiment of a cooler 1 is shown wherein the sockets 19 are integrated in the bottom 4, as recess (FIG. 4C). Clearly visible is a suction opening 21 in each of the sockets 19. The socket 19 has a somewhat recessed longitudinal edge 43 to which the bottom 16 of the inner holder 3 can connect, in liquid tight and preferably also gas tight sealing. In FIG. 4, a part of the pipe system 13 is clearly visible, and a pattern of openings 18 in the bottom 16 of the inner holder 3. Furthermore, in FIG. 4A, a two-part sliding lid is shown, and bottles 30 are received in the receiving positions. On one side, in a top side of the outer holder 2, a ventilation grille 50 is provided. In the outer holder, fans 45 can be provided (see FIG. 6) with which air can be guided through and along the outer holder 2 for, for instance, cooling the pump(s) 22 and along the compressor 10 and condenser 11. Air can be drawn in through a grille 46 near the bottom side (FIG. 5).

Figure 5:
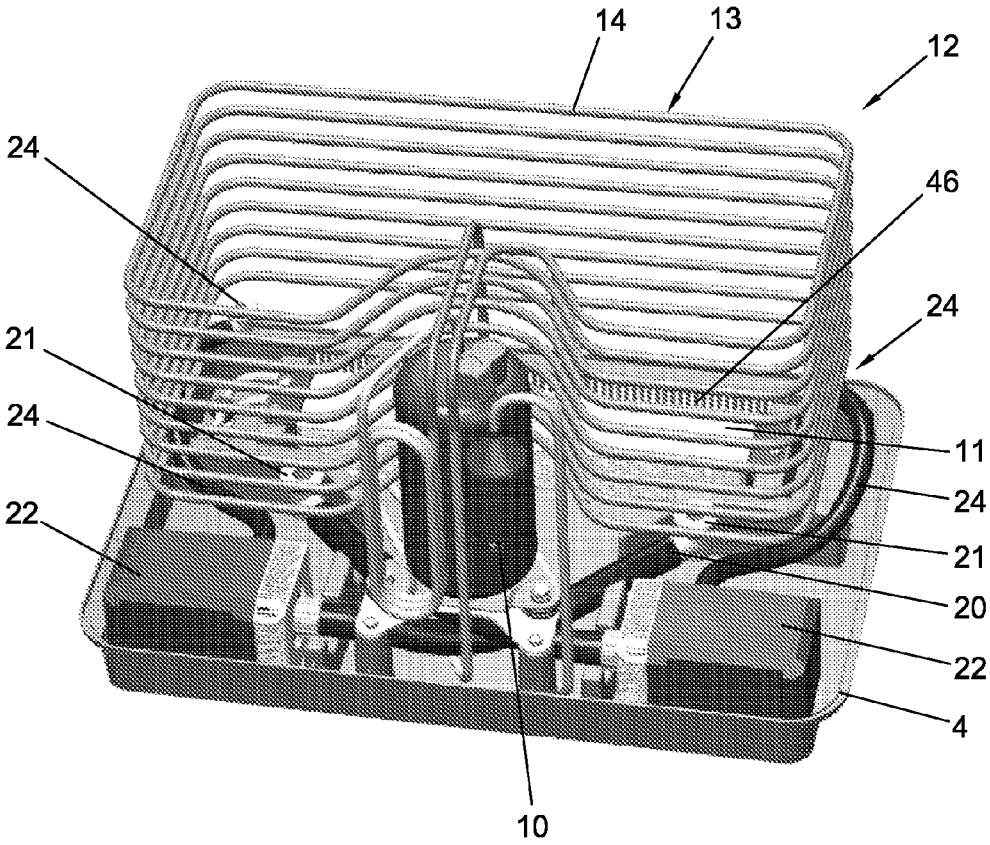
FIG. 5 shows, in perspective view, a cooler with outer and inner holder taken away.

In FIG. 5, a possible set-up of in particular the cooling device 9 and the pumps 22 with associated pipes is shown. It will be clear that this is merely an example of a possible configuration and that it should not be taken as being limitative in any manner. In this embodiment, the pipe system 13 is represented as a spiral-shaped continuous pipe 14, connected to the compressor 10 and the condenser 11. Unusual for cooling devices is that here the evaporator is located in the outer holder 2, i.e. in the space to be cooled, in contact with a liquid to be cooled 42, at least for as long as no ice layer 15 has formed on the evaporator. In contrast with what is customary, furthermore, with a cooler 1 according to the invention, it is intended that on the evaporator V, for instance against the wall 5, an ice layer 15 forms, controlled in a manner to be described further, with which a cold buffer is built up. In the embodiment of FIG. 5, the condenser 11 is placed under the inner holder 3, in the embodiment of FIG. 6 it is placed in the back of the outer holder 2, for instance directly below the fans 45.

A cooler 1 can be used as follows. The cooler 1 is fined with beverage containers 30, in the examples shown for instance twenty-four bottles 30, which are arranged in the receiving positions 29, for instance as represented and described. The bodies 51 are substantially received in the compartments 28, the necks 52 project thereabove. The cooler 1 is filled with a coolant, for instance water, water with an antifreeze component or a different coolant, so that the liquid levels Vu and Vi can be set. Then, the pump 22 and the cooling device 9 are activated. The ice sensor 37 will find no ice layer and will activate the compressor 10 via the control device 40, so that coolant is guided through the evaporator and ice will be formed thereon. The formation of ice will continue until for instance an ice layer 15 has formed with a limit value W as thickness. Preferably, the control device 40 is set such that for some time after the limit value W is reached, the compressor 10 remains switched on, so that formation of ice continues, for instance to a thickness $W_{end}$ of the ice layer 15 which is for instance approximately 1.25 to twice the limit value W. The duration of time the compressor 10 remains switched on after the limit value W has been reached can be suitably selected and can be from, for instance, a few minutes to a few hours. This duration of time may depend on the size of the cooler 1, the cooling capacity and the like. If the compressor 10 is not directly switched off upon reaching the limit value W, the advantage can be achieved that the compressor 10 is switched on and off less frequently. Furthermore, the relatively thick ice layer 15 provides a large cold buffer. With it, the low temperature of the liquid 42 can be maintained longer, also if the cooler is switched off for some time. The use of the ice layer 15 further offers the advantage that relatively little coolant 42 such as water can suffice while still bottles can be cooled for a longer period of time. Here, use can be made of a relatively small compressor because a relatively small direct cooling capacity can be used and the ice layer 15 can provide an indirect cooling capacity.

In the inner holder 3, the coolant 42 is drawn along the bottles and in particular along the bodies thereof by the pump 22, via the gap 36. As the gap 36 is relatively narrow, for instance approximately 2 mm, a high flow velocity and an intimate contact between the coolant 42 and the bottle 30 are obtained, so that a good heat transfer is obtained. The coolant 42 is drawn away through the openings 18 and, via the pump 22 and the inlet opening 23, reintroduced into the space 25 between inner holder 3 and outer holder 2. There, the coolant 42 flows upwards along the ice layer 15 and is thus cooled. Then, the coolant 42 flows back through the openings 33 into the inner holder 3. The coolant is lifted in the space 25 to the level Vu above the openings 33 but below the edge 34, so that through all openings 33 an equal amount of coolant 42 flows, well dosed and positioned. Optionally, the inner holders 3 can be in mutual liquid communication, so that level equalizing between the inner holders 3 can take place. The inner holder 3 can also be in one part, as shown in FIG. 6. The ice layer 15 provides a cold buffer for a long time. Furthermore, the coolant 42 can be cooled to a particularly low temperature, without it freezing. For instance, cooling to below 6 degrees Celsius or even below 4 degrees Celsius is possible. Preferably, in some cases, cooling to approximately 2 degrees Celsius or less takes place, for instance to approximately 0 degrees Celsius or even lower. Here, antifreeze may have been added to the coolant 42 and/or an additive reducing the freezing point, such as for instance, but not limited to, NaCl.

In this description, inner holder is at least, but not exclusively, understood to mean each construction inside the outer holder 2 in which and/or on which containers such as bottles, cans and such beverage containers can be arranged and with which, adjacent an underside of the beverage containers, coolant can be drawn away or supplied, and can be reintroduced into the space between the inner holder and the outer holder or be drawn away from there, respectively, for recirculation of the coolant along the containers and interim cooling. The inner holder 3 can also be completely or partly formed by parts fixedly connected to the outer holder such as, but not limited to, walls connected to the wall 5 and/or the bottom 4, compartmentations, pillars and the like.

In a cooler 1, for instance bottles 30 can be cooled in a relatively short period of time to approximately the temperature of the coolant 42. This may be done in for instance a period of time between a few minutes and an hour, for instance in approximately 15 to 20 minutes. However, this is not limiting for a cooler 1 according to the invention. In a particular case, shifted in phase over time, first one and then the other inner holder 3 can be filled and be emptied in the same order, so that a virtually continuous supply of cooled bottles 30 can be obtained. It will be clear that the same type of cooler 1 can also be made suitable for other bottles, cans and the like.

The invention claimed is:

1. A beverage container cooler, comprising an outer holder and at least one inner holder, received in the outer holder, provided with:

at least a series of receiving positions inside the inner holder, for beverage containers;

a cooling device for forming an ice layer between the at least one inner holder and the outer holder;

pumping means for drawing coolant from the at least one inner holder and lifting coolant between the inner holder and the outer holder; and at least one overflow for reintroducing lifted coolant into the inner holder, wherein the cooler is at least partly filled with beverage containers, wherein a receiving position encloses a beverage container relatively closely over at least a part of the height of the beverage container, wherein a receiving position comprises a wall, wherein the wall encloses a beverage container over a part of the height of the beverage container in a manner such that between the wall and the beverage container a space is enclosed with an average width of less than approximately five millimeters.

2. The cooler according to claim 1, wherein the beverage containers have a body and a neck, wherein the overflow extends at the height of the neck of the beverage containers.

3. The cooler according to claim 1, wherein the cooling device is set for cooling the coolant to less than approximately 4° C.

4. The cooler according to claim 1, wherein the at least one inner holder is provided with a compartmentation, wherein at least a number of the compartments defines a receiving position for a beverage container, wherein the compartmentation is at least partly defined by walls, wherein the walls have an upper longitudinal edge which is lower than the at least one overflow and form compartments in a side by side relationship, wherein the upper longitudinal edges of the walls together define approximately a plane which is approximately parallel to a top of the inner holder.

5. The cooler according to claim 1, wherein the cooling device is set for cooling the coolant to less than approximately 2° C.

6. The cooler according to claim 1, wherein the cooling device is set for cooling the coolant to less than approximately 0° C.

7. The cooler according to claim 1, wherein the beverage containers have a body and a neck, wherein the overflow extends above the height of the neck of the beverage containers.

8. The cooler according to claim 1, wherein the at least one inner holder is provided with discharge openings adjacent an underside of the receiving positions, wherein the pumping means are connected to the discharge openings.

9. The cooler according to claim 8, wherein the at least one inner holder is provided with a series of discharge openings which are distributed below the receiving positions such that during use, from each receiving position, per time unit approximately the same amount of coolant is drawn.

10. The cooler according to claim 1, wherein the at least one inner holder has an upper edge, wherein the overflow comprises a series of openings, at a distance from the upper edge.

11. The cooler according to claim 10, wherein the pumping means define a lifting level for the coolant, substantially to above the openings.

12. The cooler according to claim 1, wherein the at least one inner holder is provided with a compartmentation, wherein at least a number of the compartments defines a receiving position.

13. The cooler according to claim 12, wherein the compartmentation is at least partly defined by walls, wherein the walls have an upper longitudinal edge which is lower than the at least one overflow.

14. The cooler according to claim 13, wherein the upper longitudinal edges of the walls together define approximately a plane, said plane being approximately parallel to a top of the inner holder.

15. The cooler according to claim 1, wherein cooling means comprise a pipe system between the outer holder and the at least one inner holder, wherein the pipe system can be in liquid contact with the coolant, wherein the pipe system forms at least part of an evaporator of the cooling device.

16. The cooler according to claim 15, wherein the pipe system is connected to at least a compressor and an evaporator, wherein coolant is provided in the pipe system for forming during use an ice layer on the pipe system.

17. The cooler according to claim 1, wherein between the outer holder and the at least one inner holder an ice sensor is provided.

18. The cooler according to claim 17, wherein a control device is provided, connected to the ice sensor, with which the cooling device can be switched on and switched off.

19. The cooler according to claim 18, wherein the control device is designed for switching the cooling device off upon expiry of a time of passage after the ice sensor detects a first thickness of ice layer.

20. The cooler according to claim 1, wherein at least one indicator is provided from which a temperature indication of the beverage containers can be read.

21. The cooler according to claim 1, at least partly filled with beverage containers, wherein a receiving position encloses a beverage container relatively closely over at least a part of the height of the beverage container.

22. A beverage container cooler, comprising an outer holder and at least one inner holder, received in the outer holder, provided with:

at least a series of receiving positions inside the inner holder, for beverage containers;

a cooling device for forming an ice layer between the at least one inner holder and the outer holder;

pumping means for drawing coolant from the at least one inner holder and lifting coolant between the inner holder and the outer holder; and at least one overflow for reintroducing lifted coolant into the inner holder, wherein the cooler is at least partly filled with beverage containers, wherein a receiving position encloses a beverage container relatively closely over at least a part of the height of the beverage container, wherein the beverage containers have a body and a neck, wherein the overflow extends at the height of the neck of the beverage containers or thereabove, wherein the receiving position has a wall with an upper longitudinal edge, wherein the upper longitudinal edge extends at the height of the neck.

23. The cooler according to claim 22, wherein the cooling device is set for cooling the coolant to less than approximately 4° C.

24. The cooler according to claim 22, wherein the at least one inner holder is provided with a compartmentation, wherein at least a number of the compartments defines a receiving position for a beverage container, wherein the compartmentation is at least partly defined by walls, wherein the walls have an upper longitudinal edge which is lower than the at least one overflow and form compartments in a side by side relationship, wherein the upper longitudinal edges of the walls together define approximately a plane which is approximately parallel to a top of the inner holder.

25. The cooler according to claim 22, wherein the cooling device is set for cooling the coolant to less than approximately 2° C.

26. The cooler according to claim 22, wherein the cooling device is set for cooling the coolant to less than approximately 0° C.

27. The cooler according to claim 22, wherein the at least one inner holder is provided with discharge openings adjacent an underside of the receiving positions, wherein the pumping means are connected to the discharge openings.

28. The cooler according to claim 27, wherein the at least one inner holder is provided with a series of discharge openings which are distributed below the receiving positions such that during use, from each receiving position, per time unit approximately the same amount of coolant is drawn.

29. The cooler according to claim 22, wherein the at least one inner holder has an upper edge, wherein the overflow comprises a series of openings, at a distance from the upper edge.

30. The cooler according to claim 29, wherein the pumping means define a lifting level for the coolant, substantially to above the openings.

31. The cooler according to claim 22, wherein the at least one inner holder is provided with a compartmentation, wherein at least a number of the compartments defines a receiving position.

32. The cooler according to claim 31, wherein the compartmentation is at least partly defined by walls, wherein the walls have an upper longitudinal edge which is lower than the at least one overflow.

33. The cooler according to claim 32, wherein the upper longitudinal edges of the walls together define approximately a plane, said plane being approximately parallel to a top of the inner holder.

34. The cooler according to claim 22, wherein cooling means comprise a pipe system between the outer holder and the at least one inner holder, wherein the pipe system can be in liquid contact with the coolant, wherein the pipe system forms at least part of an evaporator of the cooling device.

35. The cooler according to claim 34, wherein the pipe system is connected to at least a compressor and an evaporator, wherein coolant is provided in the pipe system for forming during use an ice layer on the pipe system.

36. The cooler according to claim 22, wherein between the outer holder and the at least one inner holder an ice sensor is provided.

37. The cooler according to claim 36, wherein a control device is provided, connected to the ice sensor, with which the cooling device can be switched on and switched off.

38. The cooler according to claim 37, wherein the control device is designed for switching the cooling device off upon expiry of a time of passage after the ice sensor detects a first thickness of ice layer.

39. The cooler according to claim 22, wherein at least one indicator is provided from which a temperature indication of the beverage containers can be read.

40. The cooler according to claim 22, at least partly filled with beverage containers, wherein a receiving position encloses a beverage container relatively closely over at least a part of the height of the beverage container.

* * * * *

UNITED STATES PATENT AND TRADEMARK OFFICE

CERTIFICATE OF CORRECTION

PATENT NO. : 8,516,849 B2
APPLICATION NO. : 12/745837
DATED : August 27, 2013
INVENTOR(S) : Mooijer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 470 days.

Signed and Sealed this
Fifteenth Day of September, 2015

Michelle K. Lee

Michelle K. Lee
*Director of the United States Patent and Trademark Office*